US005377786A

United States Patent [19]

Nakagawa

[11] Patent Number: 5,377,786

[45] Date of Patent: Jan. 3, 1995

[54] ELEVATOR WITH A GOVERNOR

[75] Inventor: Toshiaki Nakagawa, Tokyo, Japan

[73] Assignee: Kabushiki Kaisha Toshiba, Kawasaki, Japan

[21] Appl. No.: 897,820

[22] Filed: Jun. 12, 1992

[30] Foreign Application Priority Data

Jun. 13, 1991 [JP] Japan ..... 3-141752

[51] Int. Cl.[6] ..... B66B 5/16

[52] U.S. Cl. ..... 187/287; 187/293; 187/276; 187/289; 187/373

[58] Field of Search ..... 187/89, 90, 73, 1 R, 187/16, 17, 38, 39, 112, 91; 188/188, 189

[56] References Cited

U.S. PATENT DOCUMENTS

| | | | |
|---|---|---|---|
| 740,566 | 10/1903 | Holger | 187/89 |
| 764,038 | 7/1904 | Carpenter | 187/89 |
| 885,560 | 4/1908 | Worthington | 187/89 |
| 3,848,706 | 11/1974 | Darwent | 187/86 |
| 3,942,607 | 8/1976 | Sobat | 187/77 |
| 3,980,161 | 9/1976 | Mauldin | 188/188 |
| 4,556,155 | 12/1985 | Koppensteiner | 187/89 |
| 4,856,623 | 8/1989 | Romig, Jr. | 188/180 |
| 5,052,523 | 10/1991 | Ericson | 187/89 |
| 5,065,845 | 11/1991 | Pearson | 187/89 |
| 5,090,515 | 2/1992 | Takahashi et al. | 187/1 R |
| 5,158,156 | 10/1992 | Okuma et al. | 187/17 |

FOREIGN PATENT DOCUMENTS

| | | | |
|---|---|---|---|
| 499379 | 1/1992 | European Pat. Off. | 187/89 |
| 0499379 | 8/1992 | European Pat. Off. . | |
| 49-36192 | 10/1974 | Japan . | |
| 51-17613 | 5/1976 | Japan . | |
| 62-136476 | 8/1987 | Japan . | |
| 778091 | 6/1955 | United Kingdom . | |
| 1189805 | 4/1970 | United Kingdom . | |

*Primary Examiner*—Kenneth W. Noland

*Attorney, Agent, or Firm*—Oblon, Spivak, McClelland, Maier, & Neustadt

[57] ABSTRACT

An elevator includes a cab supported and guided by guide rails for travel along the guide rails. Emergency stop devices for stopping the travel of the cab are fixed to the cab. Mounted on the cab is a governor for actuating the stop devices when the traveling speed of the cab exceeds a predetermined speed. The governor includes a roller mounted on the cab and in rolling contact with one of the guide rails so that the roller rolls on the guide rail in interlocking engagement upon travel of the cab. A governor pulley is rotatably mounted on the cab and connected to the roller through a belt so as to rotate in interlocking cooperation with the roller. A safety Link mechanism is mounted on the cab and actuates the stop devices when the rotating speed of the governor pulley exceeds a predetermined speed.

5 Claims, 5 Drawing Sheets

ELEVATOR WITH A GOVERNOR

BACKGROUND OF THE INVENTION

1. Field of the Invention

The present invention relates to an elevator, and more particularly, to an elevator with a governor.

2. Description of the Related Art

These days, traction-type elevators, such as the ones disclosed in Published Examined Japanese Patent Applications Nos. 49-36192 and 51-17613, prevail in the art. In the elevators of this type, a cab and a counterweight are connected by means of a main rope, such as a wire rope, which is wound around a hoist in a mechanical room at the top portion of an elevator path. The cab is moved up and down along the path as the main rope is run by means of the hoist.

Recently, moreover, automatic traveling elevators, such as the one disclosed in Published Unexamined Japanese Utility Model Application No. 62-136476, have started to be developed. In the elevators of this type, a linear motor is used having a normally conductive or superconductive magnet or the like as its drive source, and a cab is moved up and down without using the main rope.

In general, an elevator comprises a cab, having a cab frame and a cab body, and a pair of guide rails, right and left, arranged along an elevator path. The cab is guided and supported for up-and-down motion along the guide rails, by means of roller guides which are arranged individually on the right- and left-hand sides of its top and bottom. Right- and left-hand emergency stop devices for engaging the guide rails are arranged at the lower portion of the cab.

The elevator further comprises a governor which detects an excessive speed of the cab and actuates the emergency stop devices in case the traveling speed of the cab exceeds a predetermined speed from any reason. Conventionally, the governor includes a governor pulley provided at the upper end of the path, a tension sheave at the lower end of the path, and an endless governor rope passed around and between the pulley and the sheave and extending substantially throughout the length of the path. A part of the governor rope is connected to a safety link which is mounted on the cab frame. As the cab moves up or down, the governor rope travels, so that the governor pulley is rotated.

The governor pulley is rotatably supported on a stand arranged at the upper portion of the elevator path, and a rope clamping mechanism for holding the governor rope is located near the governor pulley. Further, the governor pulley is fitted with a pair of flyweights which rotate together therewith. In a traction-type elevator, for example, the governor pulley and the clamping mechanism, along with the hoist, control board, etc., are arranged in the mechanical room at the upper end of the path.

According to the elevator with the governor constructed in this manner, if the cab travels at a speed higher than the predetermined speed for any reason, the governor pulley correspondingly rotates at a speed higher than its predetermined speed. As the governor pulley rotates at this high speed, the paired flyweights spread out by means of centrifugal force, thereby actuating the rope clamping mechanism. Thereupon, the clamping mechanism clamps the governor rope, so that the rope is stopped from traveling despite the movement of the cab. As a result, the safety link, connected to the governor rope, rocks so as to actuate the emergency stop devices, whereupon the stop devices seize and stop the cab immediately.

According to the governor of the conventional elevator described above, however, the endless governor rope is expected to extend in the elevator path substantially throughout its length. If the path is very long, as in an elevator of a high building, the governor rope should be made very long and thick enough for safe operation. In this case, the force of inertia produced during the travel, as well as the gross weight of the rope, increases. Accordingly, the governor pulley, tension sheave, etc. for supporting the governor rope must be very strong, and the rope clamping mechanism for stopping the travel of the rope should be an extremely high-powered one. Inevitably, therefore, the whole governor is large-scaled, requiring an increased installation space in the travel path. Thus, besides requiring space for the actual movement of the elevator, a wide space is needed for the governor. This is adverse to effective utilization of the building space, and entails an increase in manufacturing cost. As the governor rope is lengthened, moreover, its vibration, deflection etc., increase, so that the operations of the governor and the cab must be controlled in consideration of such vibration and deflection of the rope, as well as the aforesaid weight and force of inertia. Consequently, operational control for the whole elevator is highly complicated.

In the case of the automatic traveling type, in particular, the cab can be moved up and down without using the main rope, so that the elevator may possibly enjoy a very long path of 1,000 m or more. If the governor with the aforesaid construction is used, however, the extended elevator path requires use of a long governor rope, so that the above-described problems become more serious. Thus, the advantages of the automatic traveling elevator cannot be fully utilized.

Since the main rope need not be used, in the case of the automatic traveling elevator, furthermore, it is possible that the cab could run along a ring-shaped travel path which combines vertically extending paths and horizontally extending paths. If this elevator is used in combination with the aforementioned governor, however, the arrangement of the governor rope at the junctions between the vertical and horizontal paths is very difficult. If a plurality of cabs are arranged in one travel path, as many governor ropes as there are cabs are necessary, so that the rope arrangement is further complicated.

SUMMARY OF THE INVENTION

The present invention has been conceived in consideration of these circumstances, and its object is to provide an elevator capable of detecting excessive-speed travel of a cab without using a governor rope, and enjoying a simple construction and a reduced installation space.

In order to achieve the above object, the elevator according to the present invention comprises a guide rail arranged along a predetermined travel path; a cab supported by the guide rail for travel along the guide rail; A drive mechanism for driving the cab along the travel path; a stop mechanism mounted on the cab, for stopping the travel of the cab in engagement with the guide rail; and a governor for actuating the stop mechanism when the traveling speed of the cab exceeds a predetermined speed. The governor including a rotating member mounted on the cab so as to be rollable on the guide rail, and actuator means mounted on the cab, for actuating the stop mechanism when the rotating speed of the rotating member exceeds a predetermined speed.

According to the elevator constructed in this manner, the rotating member, which is mounted on the cab, moves integrally with the cab, and is rotated in association with the travel of the cab. The actuator directly actuates the stop mechanism in accordance with the rotating speed of the rotating member. Therefore, the governor rope, which is used to rotate the governor pulley and actuate the safety link in a conventional elevator, can be omitted.

Since it is unnecessary to use the governor rope whose length is proportional to that of the travel path, the size of the governor need not be increased in proportion to the increase of the path length. Thus, the installation space for the governor in the travel path can be considerably reduced. Consequently, spaces other than the space for the actual movement of the cab can be minimized, so that the building space can be utilized efficiently.

Since the force of inertia, vibration, etc. of the governor rope need not be taken into consideration, moreover, the operation of the elevator can be controlled with ease.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiment given below, serve to explain the principles of the invention.

FIGS. 1 to 3 show an automatic traveling elevator according to a first embodiment of the present invention, in which FIG. 1 is a schematic view showing an outline of the elevator, FIG. 2 is a front view showing part of a travel path and a cab, and FIG. 3 is an enlarged view showing the principal part of a governor mounted on the cab;

DESCRIPTION OF THE PREFERRED EMBODIMENTS

Preferred embodiments of the present invention will now be described in detail with reference to the accompanying drawings.

Figure 1:
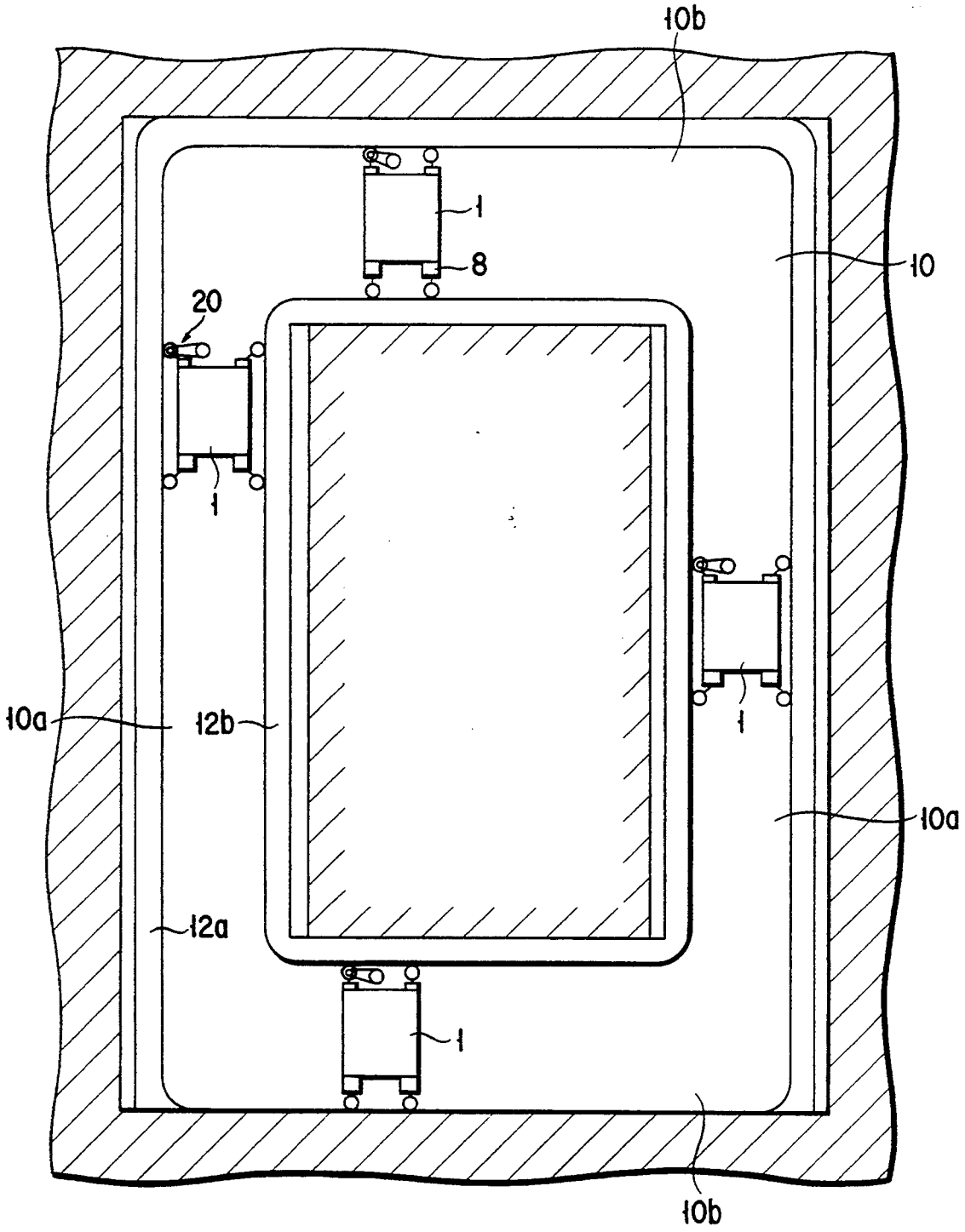
Figure 2:
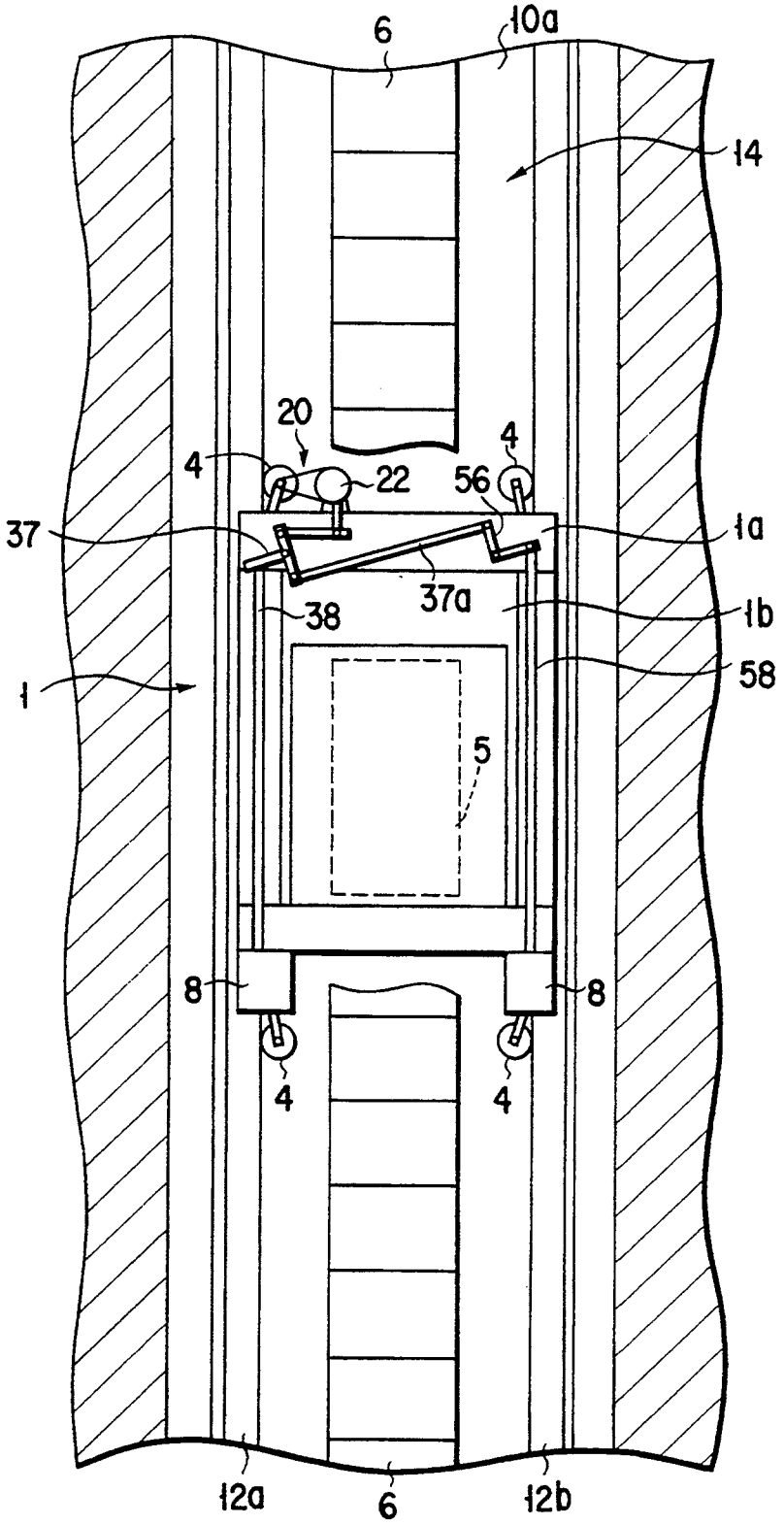
Figure 3:
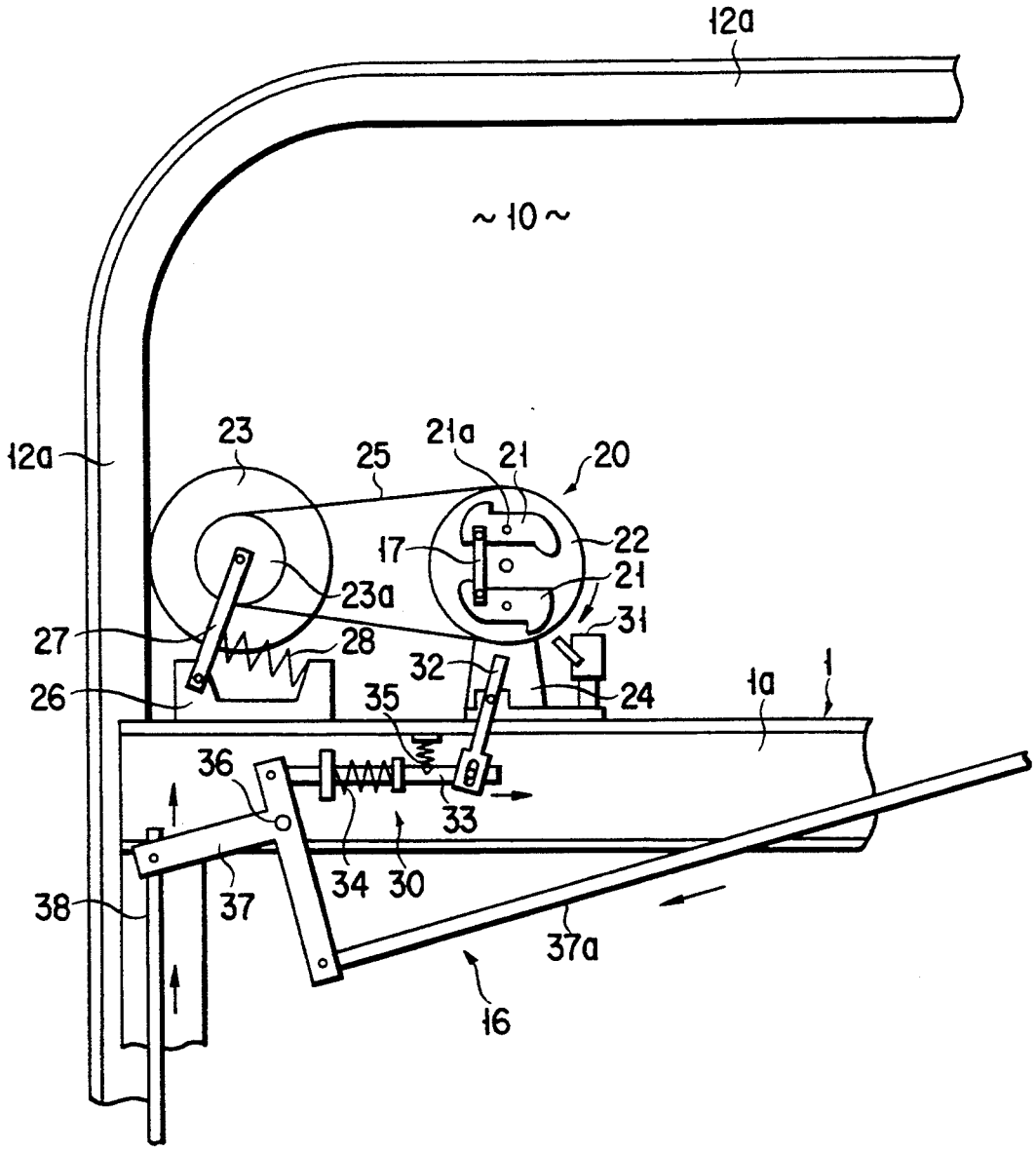

FIGS. 1 to 3 show an embodiment in which the present invention is applied to an automatic traveling elevator.

As shown in FIG. 1, the elevator comprises a ring-shaped travel path 10 which is formed in a building. The path 10 is formed of a pair of vertical sections 10*a* and a pair of horizontal sections 10*b*. Outer and inner ring-shaped guide rails 12*a* and 12*b* are arranged at a fixed distance from each other in the path 10 so as to extend along the path. A plurality of cabs 1, e.g., four in number, are arranged in the travel path 10. Each cab is guided and supported by the guide rails 12*a* and 12*b* so that they can travel along the rails.

As shown in FIG. 2, each cab 1 includes a rectangular cab frame 1*a* and a cab body 1*b* fixed therein. Roller guides 4 are mounted individually on the right- and left-hand sides of the top and bottom of the cab frame 1*a*. Each roller guide 4 is in rolling contact with its corresponding guide rail 12*a* or 12*b*. The cab 1 is guided and supported on the guide rails 12*a* and 12*b* by means of the roller guides 4. Also, a pair of emergency stop devices 8 are fixed individually to the right- and left-hand sides of the lower part of the cab frame 1*a*. Each stop device 8, which can hold its corresponding guide rail 12*a* or 12*b*, mechanically brakes the cab 1 by utilizing frictional force.

The elevator comprises a linear motor 14 as a drive source for driving the cab 1. The motor 14 includes a large number of primary-side stators 6, continuously arranged along the travel path 10, and a secondary-side reaction plate 5 fixed to the back of the cab 1 so as to face the stators 6. The stators and the reaction plate are each formed of a normally conductive or superconductive magnet. By controlling the current supply to the primary-side stators 6, the cab 1 can be moved along the guide rails 12*a* and 12*b* by means of a magnetic impellent force produced between the stators 6 and the reaction plate 5.

Each cab 1 is fitted with a governor 20. If the cab 1 runs at a speed higher than a predetermined speed, the governor 20 detects this, and actuates the emergency stop devices 8. As shown in FIGS. 2 and 3, the governor 20 comprises a governor pulley 22, a roller 23 in rolling contact with one guide rail 12*a*, and an actuating mechanism 16. As the cab 1 travels, the roller 23 rolls on the guide rail 12*a*, thereby rotating the pulley 22. The actuating mechanism 16 actuates the stop devices 8 as the pulley 22 rotates. In this embodiment, the roller 23 constitutes a rotating member according to the present invention.

More specifically, the governor pulley 22 is rotatably supported on a stand 24, which is fixed to the upper end of the cab frame 1*a*. The roller 23 has a belt pulley 23*a* formed integrally on a side face thereof, and a belt 25 is passed around and between the pulley 23*a* and the governor pulley 22. Thus, the pulley 22 is rotated in interlocking cooperation with the rotation of the roller 23. The roller 23 is formed as a member which doubles as one of the roller guides 4 for guiding the cab 1 with respect to the guide rail 12*a*. The roller 23 is rotatably mounted on one end of a supporting arm 27. The other end of the arm 27 is rockably supported on a mounting base 26, which is fixed to the upper end of the cab frame 1*a* in the vicinity of the guide rail 12*a*. Further, the roller 23 is pressed against the guide rail 12*a* by means of a compression spring 28, which is arranged between the supporting arm 27 and the mounting base 26, while traveling vertically or horizontally in the vertical or horizontal section 10*a* or 10*b* of the travel path 10, therefore, the roller 23 is bound to be continually in rolling contact with the guide rail 12*a* to guide the cab 1, and its rotation is transmitted to the governor pulley 22 by means of the belt 25.

A pair of flyweights 21, which constitute part of the actuating mechanism 16, are attached to a side face of the governor pulley 22. These flyweights 21, which are rotatable in the radial direction of the pulley 22 about a pivot pin 21*a*, are connected to each other by means of a tension spring 17. When the pulley 22 rotates at an excessive speed higher than a predetermined speed, the flyweights 21, which rotate together with the pulley 22, rotate radially outward against the urging force of the spring 17, by means of centrifugal force. Thus, the flyweights 21 spread out or move away from each other.

Further, the actuating mechanism 16 includes a safety link 30 and an operation sensor switch 31, which are mounted individually on the cab frame 1*a*, underlying the governor pulley 22. The link 30 and the switch 31 are activated when they are kicked by the flyweights 21 which are spread as the pulley 22 rotates at an excessive speed.

The safety link 30 includes a safety lever 32, a safety rod 33, and a T-shaped lift lever 37. The middle portion of the safety lever 32 is pivotally supported on the stand 24 for rocking motion. The safety rod 33, which extends horizontally, is supported on the cab frame 1*a* for horizontal movement. The lift lever 37 is rotatably mounted on the frame 1*a* by means of a pivot 36. The upper end of the safety lever 32 extends close to the governor pulley 22, and the lower end thereof is rotatably connected to the right-hand end of the safety rod 33. The rod 33 is urged toward the lever 32 by a compression spring 34. The rod 33 has a notch in the middle, and a stopper 35, urged toward the rod by a spring, is in engagement with the notch. Normally, therefore, the rod 33 is restrained from moving toward the safety lever 33 by the stopper 35, and is held in a nonoperating position shown in FIG. 3.

The lift lever 37 is rotatably supported by the pivot 36 at its crossing. The left-hand end of the safety rod 33 is rotatably connected to an upward arm portion of the lift lever 37, and the upper end of a first lift rod 38 is rotatably connected to a leftward arm portion of the lever 37. Also, one end of a connecting rod 37*a* is rotatably connected to a downward arm portion of the lift lever 37. As shown in FIG. 2, the other end of the connecting rod 37*a* is rotatably connected to an L-shaped rocking lever 56, which is rockably mounted on the cab frame 1*a*. The upper end of a second lift rod 58 is rotatably connected to the lever 56. The first and second lift rods 38 and 58 extend from the lift lever 37 and the rocking lever 56, respectively, to their corresponding emergency stop devices 8.

Each emergency stop device 8 is constructed in the same manner as a conventional device. More specifically, the device 8 includes a pair of clamping members (not shown) arranged on either side of its corresponding guide rail 12*a* or 12*b*. These clamping members are attached to the lower end of the lift rod 38 or 58 corresponding thereto. When the lift rod 38 or 58 is pulled up, the clamping members clamp the guide rail to brake the cab 1.

According to the elevator constructed in this manner, the roller 23, which doubles as the roller guide 4, rolls on the guide rail 12*a* as the cab 1 travels, and the rotation of the roller 23 is transmitted to the governor pulley 22 by means of the belt 25. Accordingly, the pulley 22 rotates at the same speed as the roller 23. If the traveling speed of the cab 1 exceeds the predetermined speed from any cause, the governor pulley 22 also rotates at a speed higher than its predetermined speed. Thus, the flyweights 21 are spread out by centrifugal force to kick and turn on the operation sensor switch 31. At the same time, the flyweights 21 kick the safety lever 32 to actuate the safety link 30.

The operation sensor switch 31 detects abnormal travel of the cab 1, and delivers an emergency stop signal to an operation control device (not shown) and a control room (not shown). In response to the emergency stop signal, the operation control device controls the current supply to the primary-side stators 6 of the linear motor 14, and electrically brakes the cab 1 by utilizing the magnetic force of the motor.

when the safety lever 32 of the safety link 30 is rocked by being kicked, in the meantime, the stopper 35 is disengaged from the notch of the safety rod 33, so that the rod 33 is unlocked. As a result, the rod 33 is urged to move toward the safety lever 32 by the spring 34, thereby rotating the lift lever 37 clockwise around the pivot 36. As the lever 37 rotates in this manner, the first lift rod 38 is pulled up, and at the same time, the second lift lever 58 is pulled up by means of the connecting rod 37*a* and the rocking lever 56. Thus, the paired emergency stop devices 8 are actuated to stop the cab 1 immediately.

According to the elevator constructed in this manner, the governor pulley 22, which is mounted on the cab 1, is moved integrally with the cab, and is also rotated by means of the roller 23 with the aid of the belt 25, when the rotating speed of the pulley 22 exceeds its predetermined speed, moreover, the actuating mechanism 16 is actuated directly by the pulley 22 without the use of a conventional governor rope. Therefore, the governor rope, which is used to rotate the governor pulley and actuate the safety link in a conventional elevator, can be omitted.

Thus, it is unnecessary to use to the governor rope whose length is proportional to that of the travel path 10, so that the size of the governor 20 need not be increased in proportion to the increase of the path length. Accordingly, the installation space for the governor 20 in the travel path 10 can be considerably reduced. Consequently, the space in the travel path can be utilized efficiently. If the linear motor 14 is used as the drive source, as in the case of the present embodiment, a hoist need not be arranged at the top portion of the path. Since the governor pulley 22 need not be provided at the top of the path, either, as mentioned before, no mechanical room is required at the top portion of the path. This is a very favorable condition for the standardization of the building height.

Since the force of inertia, vibration, etc. of the governor rope need not be taken into consideration, moreover, the operation of the elevator can be easily controlled even if the travel path is very long.

Since the conventional governor rope need not be used, furthermore, the cab 1 can move between the vertical and horizontal sections 10*a* and 10*b* of the travel path 10 without any hindrance, even though the path includes the horizontal sections 10*b*, as in the case of the present embodiment.

Figure 4:
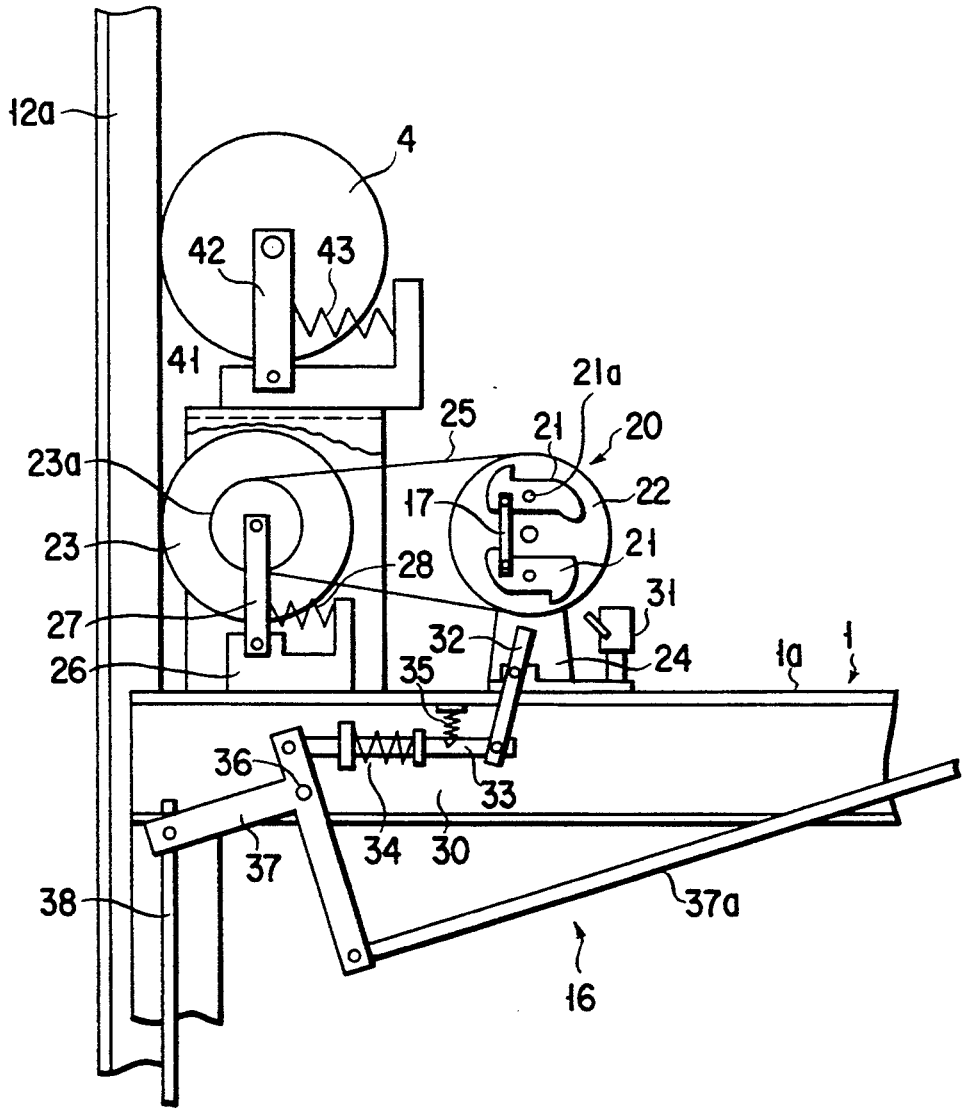
FIG. 4 is a view similar to FIG. 3, and illustrates the principal part of an elevator according to a second embodiment of the invention.

FIG. 4 shows the principal part of an elevator according to a second embodiment of the present invention.

In the first embodiment described above, the roller 23 of the governor 20 not only serves to rotate the governor pulley 22, but also doubles as the roller guide for supporting and guiding the cab 1 with respect to the guide rail 12*a*. According to the second embodiment, however, a roller 23 is provided independently of a roller guide 4. More specifically, as shown in FIG. 4, the roller 23, like the one used in the first embodiment, is mounted on a cab frame 1*a* by means of a mounting base 26, and is in rolling contact with a guide rail 12*a*. The roller guide 4 is situated over the roller 23, and is mounted on the cab frame 1*a* by means of a mounting base 41 and a supporting arm 42. Furthermore, the guide 4 is pressed against the guide rail 12*a* by means of a compression spring 43, which is arranged between the base 41 and the arm 42. For the arrangement of the other components, there is no difference between the first and second embodiments. Therefore, like reference numerals are used to designate like portions throughout the drawings for simplicity of illustration.

Also in the second embodiment, the conventional governor rope may be omitted, and the same advantages of the first embodiment can be obtained. In the case of the present embodiment, however, the roller 23 does not roll on the guide rail 12*a* as the cab 1 travels in the horizontal direction, so that abnormal travel of the cab 1 cannot be detected. Accordingly, the present embodiment can be applied only to those elevators whose travel path is composed of vertical sections only.

In the first and second embodiments, the governor pulley 22 and the roller 23 are linked to each other by means of the belt 25. Alternatively, however, the belt for use as linkage means may be replaced with a combination of a chain and a sprocket or a gear train.

Figure 5:
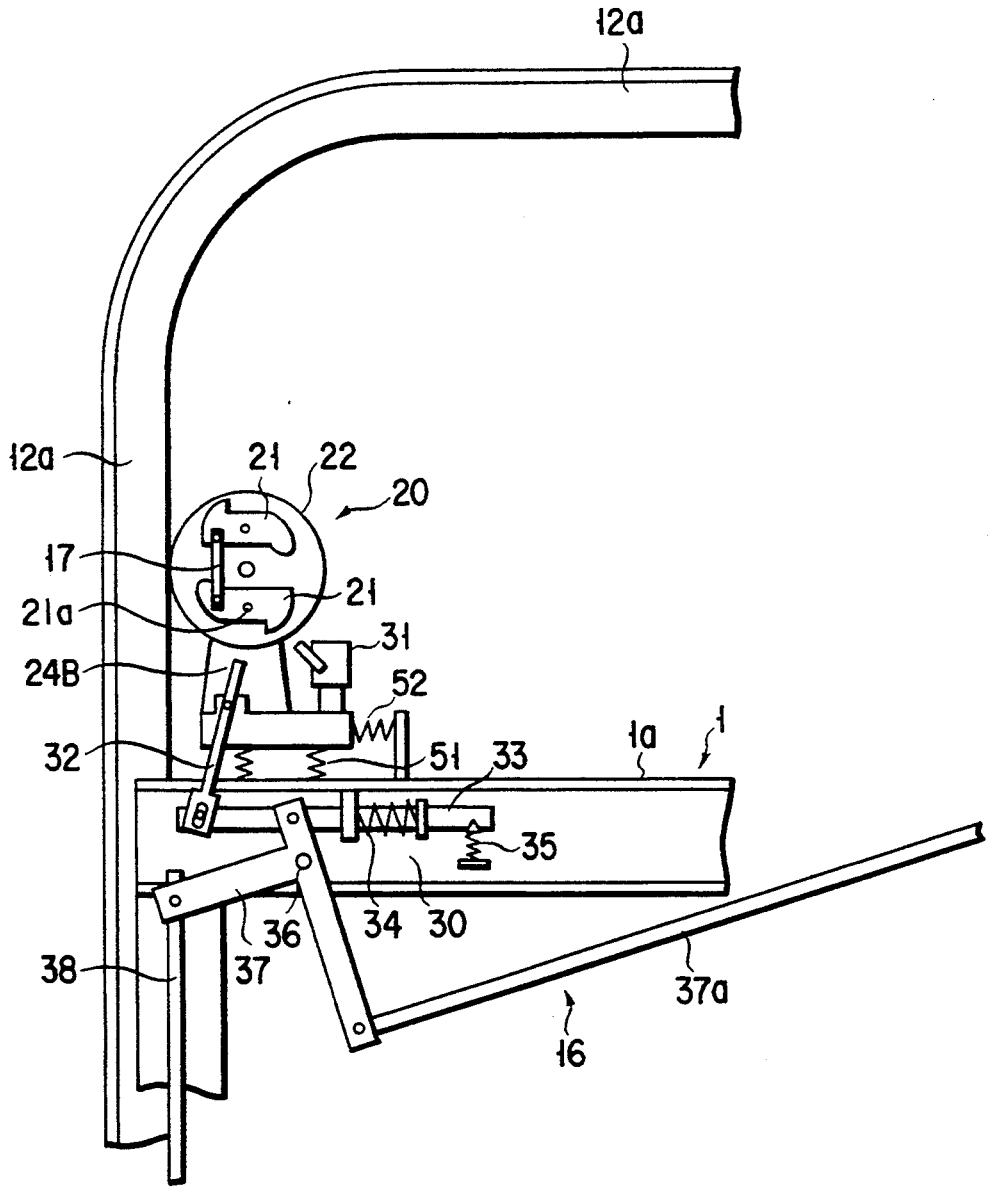
FIG. 5 is a view similar to FIG. 3, and illustrates the principal part of an elevator according to a third embodiment of the invention.

FIG. 5 shows the principal part of an elevator according to a third embodiment of the present invention. According to this embodiment, the roller of the foregoing embodiments is omitted, and a governor pulley 22 on a cab frame 1*a* is directly in rolling contact with a guide rail 12*a*. The pulley 22 constitutes a rotating member according to the present invention. Thus, the pulley 22 is rotatably supported as a roller on a stand 24. The stand 24 is supported on the cab frame 1*a* in the vicinity of the rail 12*a* by means of a plurality of vertically extending compression springs 51 and a horizontally extending compression spring 52. When the cab 1 travels in a vertical section 10*a* or a horizontal section 10*b* of a travel path 10, the governor pulley 22 is urged by the springs 51 and 52, and rotates securely in contact with the guide rail 12*a*. The arrangement of the other components is substantially the same as in the first embodiment. Therefore, like reference numerals are used to designate like portions throughout the drawings for simplicity of illustration.

Also in the third embodiment, the same advantages of the first embodiment can be obtained. In the present embodiment, the governor pulley 22 may be formed as a member which doubles a roller guide for guiding and supporting the cab 1 with respect to the guide rail 12*a*.

It is to be understood that the present invention is not limited to the embodiments described above, and that various changes and modifications may be effected therein by one skilled in the art without departing from the scope or spirit of the invention.

What is claimed is:

1. An elevator comprising:

a guide rail arranged along a predetermined travel path;

a cab supported by the guide rail for travel along the guide rail;

a drive mechanism for moving the cab along the travel path, the drive mechanism including a linear motor having a plurality of primary-side stators arranged along the travel path and a secondary-side reaction member mounted on the cab and facing the primary-side stators;

a stop mechanism mounted on the cab, for engaging the guide rail to stop the travel of the cab; and a governor for actuating the stop mechanism when the traveling speed of the cab exceeds a predetermined speed, the governor including a roller mounted on the cab to be rollable on the guide rail, a governor pulley rotatably arranged on the cab, a belt passed around and between the roller and the governor pulley, for rotating the governor pulley in interlocking engagement with the roller upon rotation of the roller, and an actuator mounted on the cab for actuating the stop mechanism when the governor pulley rotates at a speed higher than the predetermined speed, the actuator including a link mechanism connected to the stop mechanism is, a lock mechanism having a safety lever located in proximity with the governor pulley, for locking the link mechanism in a nonoperating position, and a flyweight mounted on the governor pulley, for pushing the safety lever to release the lock mechanism and shift the lock mechanism to an operating position for actuation of the stop mechanism when the governor pulley rotates at a speed higher than the predetermined speed.

2. An elevator according to claim 1, which further comprises a plurality of roller guides rotatably mounted on the cab and in rolling contact with the guide rail.

3. An elevator according to claim 2, wherein one of said roller guides comprises said roller of the governor.

4. An elevator according to claim 1, wherein said governor includes a switch mounted on the cab and adapted to be shifted by the flyweight to output a detection signal when the governor pulley rotates at a speed higher than the predetermined speed.

5. An elevator according to claim 1, wherein said travel path includes a vertical section extending substantially vertically and a horizontal section extending substantially horizontally and communicating with the vertical section.

* * * * *